United States Patent [19]

Rudy et al.

[11] Patent Number: 4,881,994

[45] Date of Patent: Nov. 21, 1989

[54] IRON OXIDE CATALYST PROPELLANT, AND METHOD FOR MAKING SAME

[75] Inventors: Thomas P. Rudy, Saratoga; Forrest R. Goodson; Mark E. Dudley, both of San Jose, all of Calif.

[73] Assignee: United Technologies Corporation, Hartford, Conn.

[21] Appl. No.: 44,097

[22] Filed: Apr. 30, 1987

[51] Int. Cl.[4] ..... D03D 23/00

[52] U.S. Cl. ..... 149/109.4; 149/20; 149/76; 149/77; 149/83; 149/109.6; 149/110; 423/632; 502/325

[58] Field of Search ..... 423/632; 502/325; 149/20, 109.4, 109.6, 110, 76, 77, 83

[56] References Cited

U.S. PATENT DOCUMENTS

| | | | |
|---|---|---|---|
| 3,677,839 | 7/1972 | Sayles | 149/19 |
| 3,932,242 | 1/1976 | Bartley et al. | 149/19.9 |
| 4,003,850 | 1/1977 | Callighan et al. | 502/336 |
| 4,023,994 | 5/1977 | Arendale | 149/19.2 |
| 4,120,709 | 10/1978 | Hamner et al. | 149/19.92 |
| 4,424,085 | 1/1984 | Fukuma et al. | 149/19.1 |
| 4,608,239 | 8/1986 | Devon | 423/210 |

OTHER PUBLICATIONS

"Flame Synthesis of Fine Particles", by Gael D. Ulrich, Aug. 6, 1984, C&EN, pp. 22–29.

"Particle Growth in Flames–III, Coalescence as a Rate–Controlling Process", G. D. Ulrich & N. S. Subramanian, Combustion Science & Technology, 1977, vol. 17.

"Theory of Particle Formation & Growth in Oxide Synthesis Flames", G. D. Ulrich, Combustion Science & Technology, 1971, vol. 4, pp. 45–57.

"Aggregation & Growth of Submicron Oxide Particles in Flames", G. D. Ulrich, Journal of Colloid & Interface Science, vol. 87, No. 1, May 1982, pp. 257–265.

Chart–Mapico Iron Oxides, (Cities Service, Columbian Division Citco), pp. 119–126.

"Preparation in a Hydrogen–Oxygen Flame of Ultrafine Metal Oxide Particle" by Formenti et al., Journal of Colloid and Interface Science, vol. 39, No. 1, Apr. 1972.

"Transparent Purple Iron Oxide from the Combustion of Iron Carbonyl" by Ostertag et al., Defacent 33, No. 12–1979.

*Primary Examiner*—Stephen J. Lechert, Jr.

[57] ABSTRACT

A method of making a ferric oxide burning rate catalyst that results in a highly active, finely divided burning rate enhancing catalyst. An iron-containing compound that is capable of vaporization at a temperature below about 500° C. is vaporized. A mixture comprising the vaporized iron-containing compound is combusted with a gas that is capable of supporting combustion in an oxygen environment and does not condense below about 100° C. The ferric oxide burning rate catalyst made by this process is particulary adapted for use in a composite solid rocket propellant. This process provides an ultra pure, highly active, finely divided burning rate catalyst.

7 Claims, 6 Drawing Sheets

IRON OXIDE CATALYST PROPELLANT, AND METHOD FOR MAKING SAME

TECHNICAL FIELD

This invention relates to a composite solid propellant and method for making the same.

BACKGROUND ART

In the field of composite solid propellants for various rocket motors, a continuing desire is to increase the burning rate. An increase in the burning rate of a solid propellant leads to an increase in the mass flux of combustion gases, hence an increase in thrust. Accordingly, it becomes possible to increase the launching velocity of the rocket or, when there is no need of increasing the launching velocity, to reduce the burning surface area. In the latter case, the loading efficiency (mass fraction of propellant) may be increased. Thus, solid propellants of increased burning rates are the basis of solid propellant rocket motors of relatively small size but relatively high thrust and will certainly contribute to broadening of the applicability of end-burning rocket motors.

Typically, the burning rate of a composite solid propellant is increased with minimum effect on other properties by using an additive that catalyzes the reaction between the oxidizer and the binder (fuel) in the propellant. Until now, various metal oxide powders have been proposed as the burning rate increasing additive or catalyst, but most of them have proved to be impractical because they promote degradation of conventional rubber binders. The most useful binders contain a substantial concentration of polybutadiene, an unsaturated hydrocarbon that provides elasticity. The olefinic unsaturation is very vulnerable to attack by atmospheric oxygen, particularly when catalyzed by traces of most elements of the first transition series of the periodic chart. Thus, propellants formulated with oxides of these metallic elements suffer hardening and embrittlement in storage and become unfit for use.

The most practical choice among the hitherto proposed metal oxide catalysts has been ferric oxide, either hydrous (FeOOH) as described in U.S. Pat. No. 4,424,085; Anchor FY-842 TM FeOOH (Toho Ganryo Kogyo Co. Ltd.); and Mapico Yellow 300 TM FeOOH (Cities Service Co., Columbian Division Citgo) or anhydrous ($Fe_2O_3$). The major limitation of ferric oxide is that the catalytic efficiency diminishes rapidly as its concentration is increased. Moreover, acceptable rheology of the uncured propellant and tensile properities after cure impose a strict upper limit on the allowable concentration of solid ingredients. Hence, ferric oxide, which provides a negligible contribution to impulse, must be added at the expense of ballistically valuable solid ingredients, typically ammonium perchlorate oxidizer or powdered aluminum fuel.

To circumvent the aforementioned solids loading limitation, it has been proposed to use liquid organoiron compounds (e.g., alkylferrocene derivatives (see U.S. Pat. No. 4,120,709) as catalysts for increasing burning rate. These substances offer acceptable fuel value and may be substituted for a fraction of the organic binder. Thus, they may be used at relatively high concentration with relatively little degradation of rheology, tensile properties or delivered impulse. Unfortunately, these catalysts suffer several important limitations. They greatly depress the autoignition temperature of a propellant and thereby increase the hazard of accidental ignition by friction, impact, or any other source of heat. They also migrate readily from the propellant into inert organic substrates such as liners and insulators. Finally, they can impair aging stability at elevated temperature in air. In addition, they are relatively expensive.

Accordingly, there has been a constant search in this field of art for propellant catalysts having improved properties.

DISCLOSURE OF INVENTION

This invention is directed to a method of making a ferric oxide burning rate catalyst that results in a highly active, finely divided burning rate catalyst. An iron-containing compound that is capable of vaporization at a temperature below about 500° C. is vaporized. A mixture comprising the vaporized iron-containing compound is combusted with a gas that is capable of supporting combustion in an oxygen environment and does not condense below about 100° C.

Another aspect of this invention is a ferric oxide burning rate catalyst made by this process.

Yet another aspect of this invention is a composite solid rocket propellant comprising a ferric oxide burning rate catalyst made by this process.

These processes and catalysts make a significant advance in the field of burning rate catalysts for solid rocket motors. This process provides an ultra pure, highly active, finely divided burning rate catalyst.

The foregoing and other objects, features and advantages will be apparent from the specification, claims and from the accompanying drawings which will illustrate an embodiment of the invention.

BEST MODE FOR CARRYING OUT THE INVENTION

Figure 1:
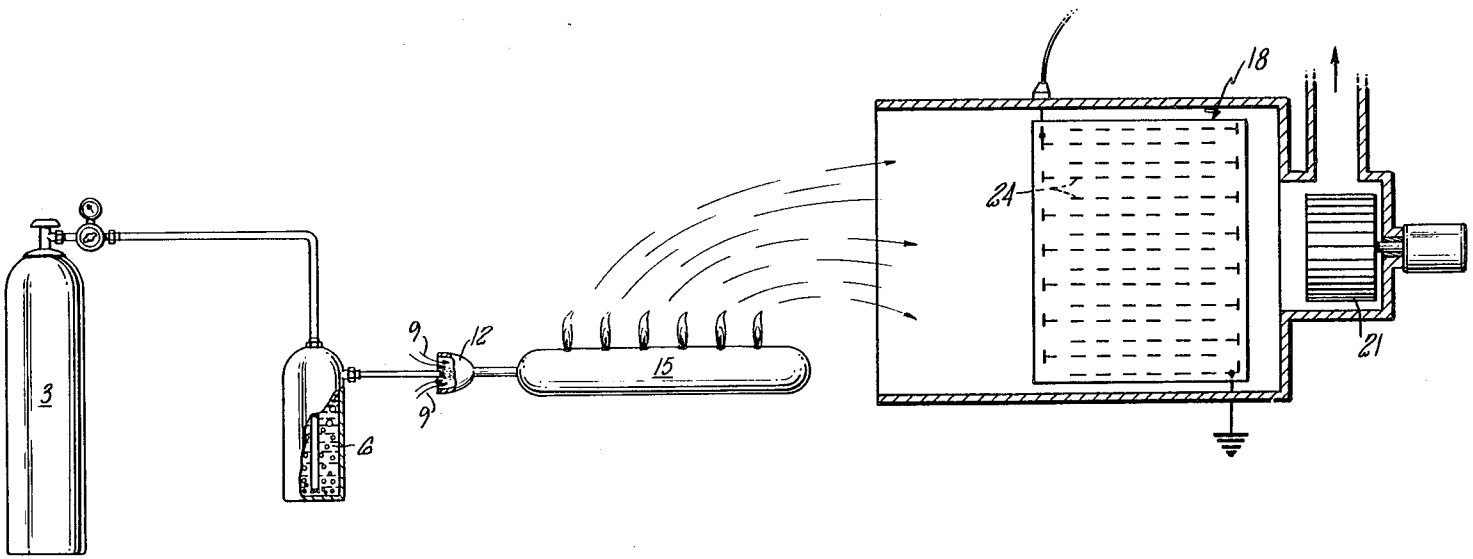
FIG. 1 schematically illustrates the method of making the iron oxide catalyst according to this invention.

Generally, any iron-containing compound that is capable of vaporization at a temperature below about 500° C. may be used in the practice of this invention. It is important that the compound is capable of vaporization at these temperatures because above about 500° C., it is difficult to vaporize the iron compounds and maintain them vaporized in admixture with the carrier gas (e.g., a more volatile compound is readily processed to prepare the catalysts of this invention). It is especially preferred to employ a compound that has a melting point lower than the vaporization temperature because the compound is conveniently vaporized by bubbling the carrier gas through the liquified compound. It is also preferred that the iron-containing compound have a high iron content to increase the yield of the desired iron oxide product. It is also preferred that the iron compound be both thermally stable and unreactive with the carrier gas, at the vaporization temperature, to avoid fouling the apparatus which involatile residues. Finally, it is preferred that the iron-containing compound be essentially free of any impurities that will not be burned to form harmless gases in the combustion step. In particular, impurities containing metals other than iron are usually very undesirable.

Preferred generic classes of iron-containing compounds are carbonyls, ferrocene or a derivative thereof, chelates of $\beta$ diketones of low molecular weight (e.g., ferric acetylacetonate), halides and complex ferri- or ferrocyanides, or mixtures thereof. These are preferred because they are volatile, susceptible to oxidation and they contain a high concentration of iron. It is especially preferred that iron pentacarbonyl available from Pressure Chemical Co. (Pittsburgh, PA) be used because of its high volatility, low melting point, high iron content, stability in the dark at temperatures well above its boiling point and unreactivity with preferred carrier gases. Finally, it produces a superior catalyst.

Generally, any gas (e.g., fuel, auxiliary gas, carrier gas) that is both capable of supporting combustion in an oxygen environment and does not condense below about 100° C. may be used in the practice of this invention. By capable of supporting combustion is meant continuing to burn stably upon ignition in the presence of a substantial concentration of oxygen (e.g., in air). Combustibility of the fuel gas is important to the successful practice of the invention when oxidation-resistant iron-containing compounds are used. For example, a hydrogen donating fuel is required to complete the conversion at flame temperatures of an iron halide to iron oxide and gaseous hydrohalic acid. It is important that the boiling point of the fuel gas be below about 100° C. because above about 100° C. impractical and expensive heating of the gas feed line is required to prevent condensation of the fuel gas.

Exemplary generic classes of these gases are lower hydrocarbons, lower ethers and lower oxides of carbons. It is especially preferred that methane (e.g., natural gas) be used because it is readily available.

The catalysts of this invention may be made by the vaporization of the above-described iron-containing compounds and combustion in an oxygen-containing stream of the fuel gas described above. Generally, the oxygen must be present in at least about 10% by volume in the surrounding atmosphere in order to ensure stability of the fuel gas flame. Typically, the fuel gas must be present at no less than about 3% by volume for stable combustion to occur.

Although a combustible fuel gas is typically necessary, it has been found that an incombustible carrier gas is suitable when vapors of a particularly oxidation-susceptible iron-containing compound (e.g., iron pentacarbonyl) are mixed with an oxygen-containing atmosphere at high temperature. This flameless oxidation process, which produces a very active iron oxide catalyst is the subject of commonly assigned copending application D-1370, the disclosure of which is hereby incorporated by reference.

According to FIG. 1, for those iron-containing compounds that are liquids at the vaporization temperature, the flammable carrier gas 3 may be bubbled through the iron-containing liquid 6 and the resulting vapor/gas mixture fed with air 9 to the fuel inlet 12 of a conventional gas/air burner 15. Upon ignition of the burner, the combustion products are drawn through an electrostatic precipitator 18 by a squirrel cage blower 21. A suitable electrostatic precipitator is an Emerson Electronic Air Cleaner, Model 14C22M-41000, available from White-Rodgers, Inc., Electro-Air Division (Harrison, Ark.). A suitable squirrel cage blower is a Dayton 525 cfm Blower-AOL, Model 4C3445-A, available from W. W. Grainger, Inc. (Chicago, IL). The resulting catalysts may then be collected by scraping or simply shaking the electrodes 24 of the precipitator.

Those iron-containing compounds that are solids at the vaporization temperature may be vaporized into the carrier gas by directing a stream of the latter over the surface of the solid compound and continuing as described above with combustion, precipitation and collection. It is preferable that the vapor pressure of the solid compound be greater than about 0.005 atmospheres. This enables the production of adequate quantities of catalyst. It is especially preferred that the vapor pressure be greater than about 0.01 atmospheres to provide a conveniently high rate of production of catalyst. These vapor pressures can be achieved by raising the temperature of the vaporizing compound.

Figure 2:
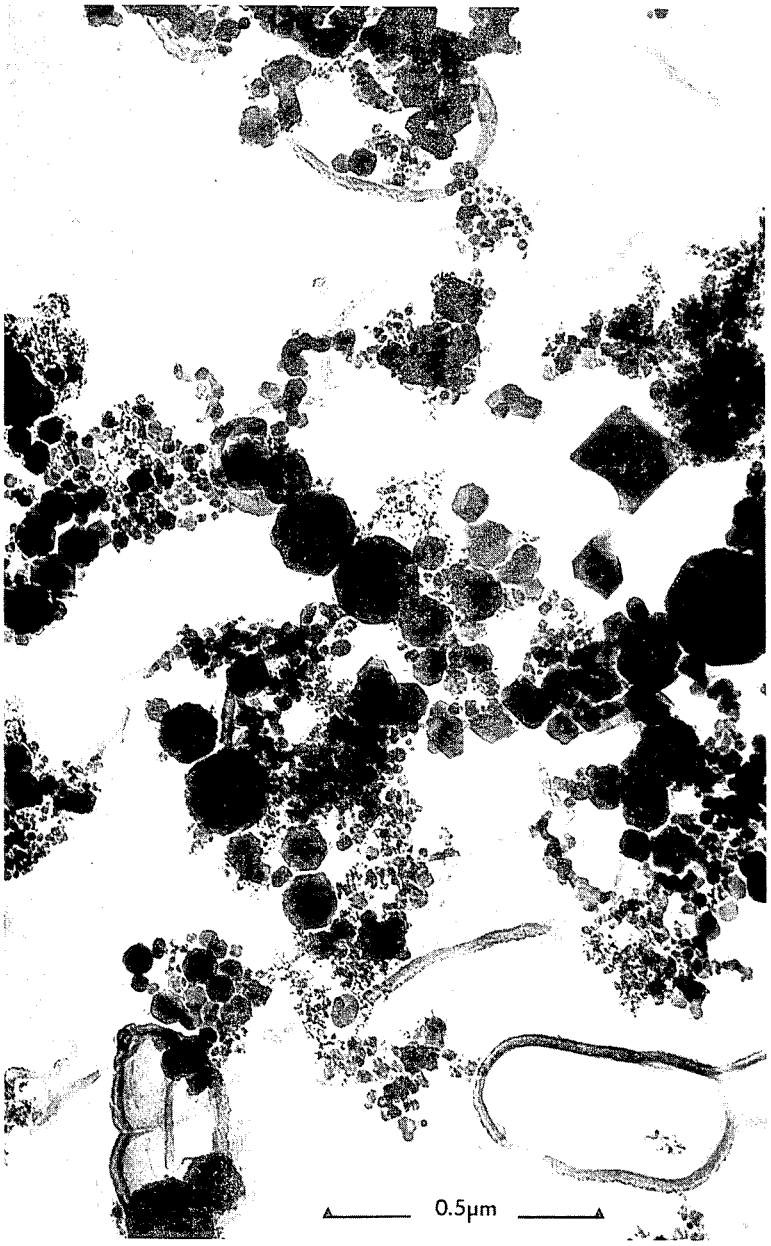
FIGS. 2 and 3 are transmission electron micrographs of the ferric oxide particles of this invention.
Figure 3:
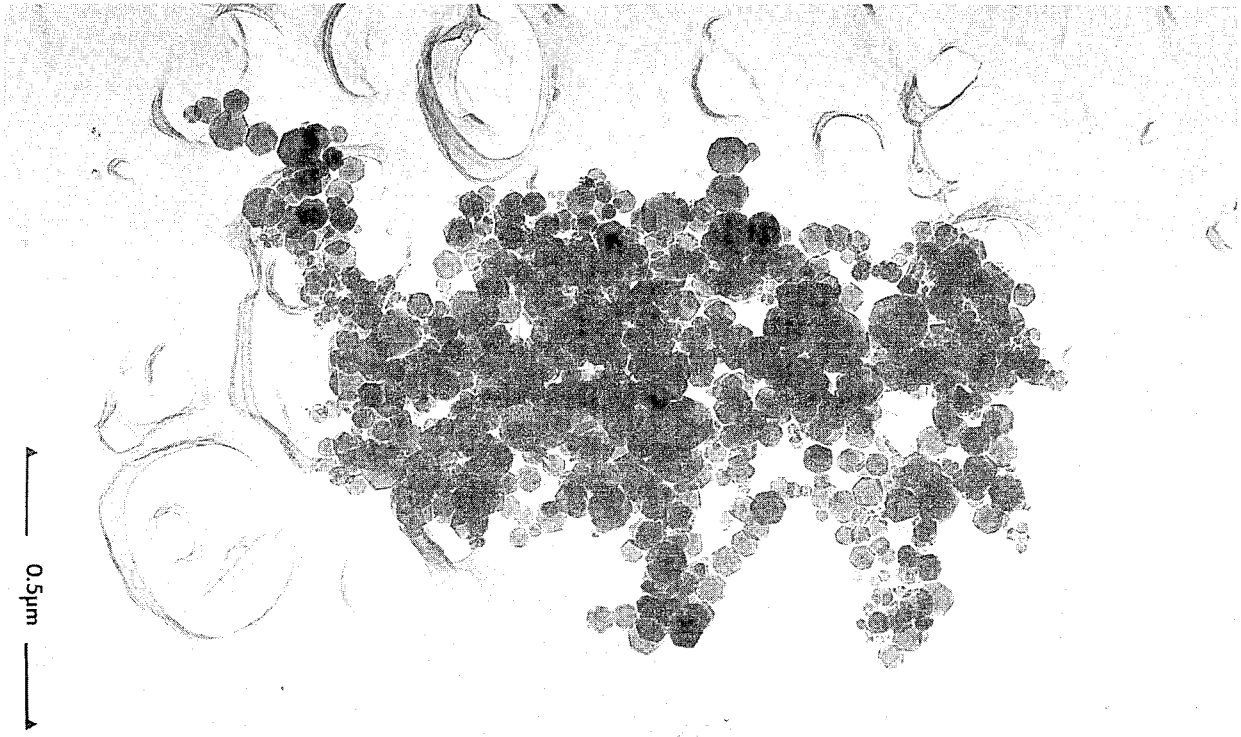

The product of these processes is a very finely divided, highly catalytically active, anhydrous oxide. A number of characteristics are believed to contribute to its high activity. The most important is its enormous surface area provided by average particle diameters that, depending on reaction conditions, range from about 2000 angstroms (Å) to less than about 100 Å. The shape is substantially symmetric about a point. These globular shapes provide improved processibility. Typically, the average calculated specific surface area is greater than about 20 meters per square gram ($m^2/g$). FIGS. 2 and 3 depict transmission electron micrographs of two lots of the ferric oxide catalyst of this invention. In FIG. 2, the particles are about 2000 Å to less than about 100 Å in size. In FIG. 3, the particles are about 1000 Å to less than about 100 Å in size.

Figure 4:
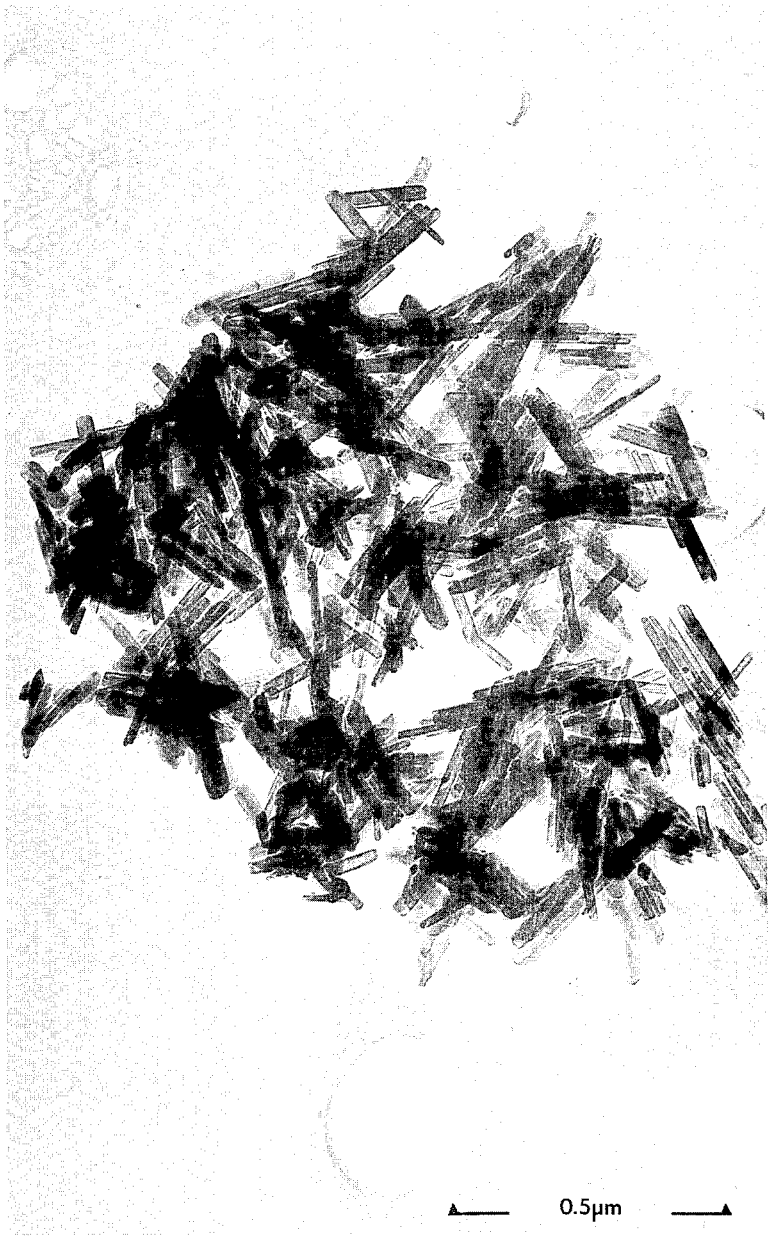
FIGS. 4 and 5 are transmission electron micrographs of Mapico Yellow 300 TM FeOOH and Anchor FY-842 TM FeOOH respectively.
Figure 5:
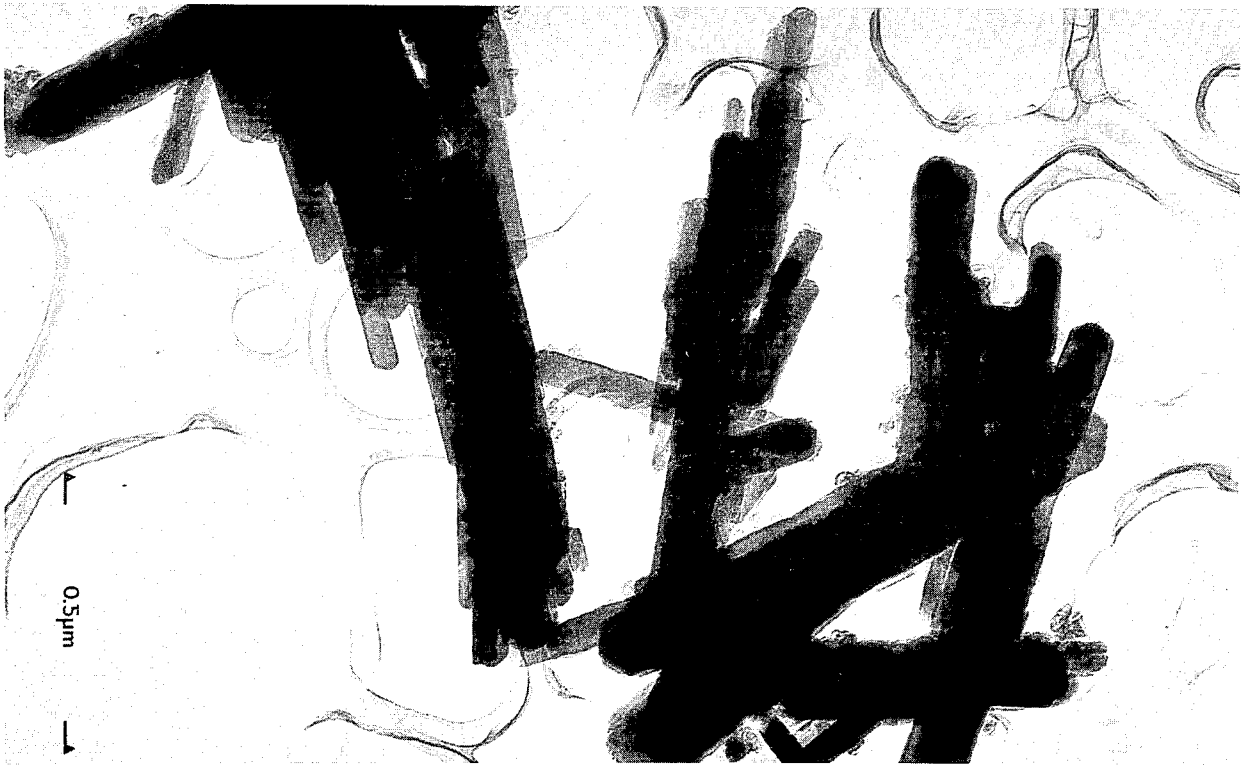

In contrast, FIG. 4 depicts a transmission electron micrograph of Mapico Yellow 300 FeOOH. The particles are rod shaped and typically about 3500 Å long by about 250 Å diameter. Their average surface area is believed to be about 30 $m^2/g$. FIG. 5 depicts a transmission electron micrograph of Anchor FY-842 FeOOH. The particles again are rod shaped and typically about 10,000 Å long by about 750 Å diameter. The average specific surface area is typically about 10 $m^2/g$. Generally, both of these particles are substantially axisymmetric. Their acicular shapes impair rheology and make propellant processing difficult.

A second characteristic of the catalysts of this invention is the chemical composition of the novel catalyst, substantially pure ferric oxide. It is stable at flame temperatures and therefore is believed to be the form responsible for catalysis of combustion. It is believed that other forms of iron or iron oxide (for example, hydrated ferric oxide, FeOOH) must be converted to ferric oxide before they become active. This delays catalysis and thereby diminishes catalytic efficiency. In the case of certain iron-containing catalysts, including hydrated ferric oxide, FeOOH, the yield of active ferric oxide in the flame is less than the amount of precursor added to the propellant formulation.

Third, the surface microstructure of the novel catalyst is believed to be especially active. The active sites on solid, inorganic oxidation catalysts are believed to be characterized by defects in the crystal lattice that promote the desired adsorption of reagents and desorption of products in the catalyzed process. Because the catalyst of this invention is synthesized in a redox flame, it is believed to possess at the outset an active surface microstructure that must be acquired in a flame of burning propellant by other catalysts.

Finally, the novel catalyst is free of the undesirable impurities (e.g., halides and sulfates) that are typically adsorbed upon iron oxides that are conventionally prepared in aqueous solution inherently containing high concentrations of foreign ions. Such impurities are often responsible for acceleration of cure (short pot life of uncured propellant) and for accelerated oxidative degradation of olefinically unsaturated binders (e.g., polybutadiene). In contrast, this process eliminates the solutions and thus the impurities. Also, the hydrated ferric oxide catalysts must be rigorously dried to remove tenacious adsorbed moisture that interferes with the cure of the propellant by reacting destructively with curing agents (e.g., isocyanates).

Typically, the catalysts of this invention are used as a burning rate accelerator for an ammonium perchlorate based rocket propellant. However, it is also believed that propellants based on other perchlorates (e.g. potassium perchlorate) would be enhanced with the use of the above catalyst. Typically, a variety of other conventional components and additives are compounded (added) in conventional amounts for use as a rocket propellant. An exemplary list of additives includes fuel binders, curing agents, plasticizers, adhesion-increasing agents (i.e., bonding agents) antioxidants, powdered metal fuels, and combustion stabilizers.

EXAMPLE

A stream of propane gas was bubbled at a rate of 12 liters per minute for 300 minutes through a gas washing bottle fitted with a dip tube that projected beneath the surface of 100 grams of liquid iron pentacarbonyl at room temperature. The resulting gaseous mixture was fed to the gas inlet of a LPG/air burner available from W. C. Bradley Enterprises, Inc. of Columbus, Ge. The burner was ignited and the combustion products were drawn through an electrostatic precipitator available from White-Rodgers, Inc., Electro-Air Division (Harrison, Ark.) by a squirrel cage blower available from W. W. Grainger of Chicago, IL. The combustion occurred at approximately 1900° C. The combustion was allowed to occur for 300 minutes. When sufficient product had accumulated on the precipitator, the flow of propane gas/iron pentacarbonyl vapor was stopped, the power to the precipitator was turned off, and 12.3 grams of pyrogenic ferric oxide was removed by scraping from the precipitator plates.

Seven ammonium perchlorate based propellants were similarly compounded. However, six substituted 0.10 weight percent (%) burning rate catalyst for an equal % of bonding agent (labeled D, E, F, G, I, and J). The above propellants were static tested at various pressures in small rocket motors with the following grain dimensions:

Outer diameter—5.08 cm (2 inches)
Inner diameter—3.81 cm (1.5 inch)
Length—9.525 cm (3.75 inches)
Web—0.635 cm (0.25 inch)
Burning area—132 $cm^2$ (20.4 square inches)
Mass—145 grams (0.32 pounds)

Figure 6:
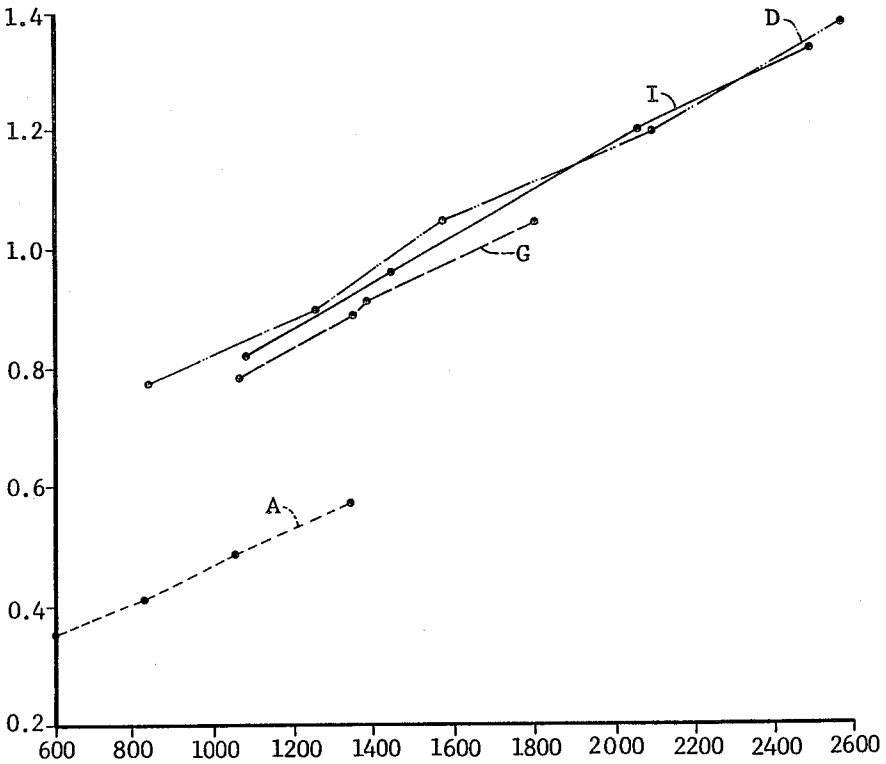
FIG. 6 graphically depicts the relation of burning rate to pressure for a control propellant, the same formulation to which a catalyst of this invention has been added, and two same formulations to which different conventional iron oxide catalysts have been added.

The results of the motor tests are depicted in the following table and in FIG. 6. The following table illustrates that the pyrogenic iron oxide of this invention is substantially superior to conventional catalysts except Mapico Yellow 300. However, FIG. 6 illustrates that the pyrogenic iron oxide catalyst of the present invention is about equivalent to Mapico Yellow 300 in elevating the burning rate of the control formulation. The catalyst of this invention provides not only a high burning rate but also a desirably low pressure exponent.

BURNING RATES OF PROPELLANTS

| Sample No. | Catalyst 0.10% Weight | Pressure Pounds Per Square Inch | Burn Rate Inch/Second | Calculated $r_{1000}^1/n^2$ |
|---|---|---|---|---|
| A | None (Control) | 600 | 0.352 | 0.47/0.62 |
| | | 828 | 0.412 | |
| | | 1053 | 0.484 | |
| | | 1341 | 0.571 | |
| D | Mapico Yellow | 836 | 0.774 | 0.82/0.54 |
| | 300 | 1256 | 0.896 | |
| | FeOOH | 1567 | 1.046 | |
| | | 2082 | 1.196 | |
| | | 2557 | 1.381 | |
| E | Mapico 516M | 1171 | 0.781 | 0.68/0.67 |
| | $Fe_2O_3$ | 1567 | 0.883 | |
| | | 2183 | 1.126 | |
| | | 2802 | 1.366 | |
| F | Anchor FY-842 | 450 | 0.455 | 0.69/0.62 |
| | FeOOH | 1032 | 0.676 | |
| | | 1470 | 0.865 | |
| | | 2486 | 1.238 | |
| G | Superfine Iron | 1068 | 0.789 | 0.76/0.54 |
| | Oxide #6 | 1353 | 0.893 | |
| | $Fe_2O_3$ | 1389 | 0.912 | |
| | | 1796 | 1.042 | |
| I | Superfine Iron | 1082 | 0.82 | 0.78/0.60 |
| | Oxide #5 | 1439 | 0.96 | |
| | $Fe_2O_3$ | 2048 | 1.2 | |
| | | 2476 | 1.34 | |
| J | Catocene | 650 | 0.65 | 0.74/0.48 |
| | Approximately | 950 | 0.71 | |
| | $Fe_2C_{27}H_{32}$ | 1250 | 0.8 | |
| | | 1600 | 0.9 | |
| | | 2050 | 1.03 | |
| | | 2800 | 1.25 | |

[1]Burning Rate at 1000 psi
[2]Pressure Exponent

Although this invention has been described in terms of the production of a ferric oxide catalyst for use in rocket propellants, the ferric oxide may also be used advantageously in other gas-phase oxidation processes requiring a solid, refractory catalyst of high surface area.

This invention provides a convenient process for producing a rocket propellant burning rate catalyst that has excellent catalytic activity. Specifically, the process results in a very finely divided ferric oxide that produces a high burning rate and a low pressure exponent.

It should be understood that the invention is not limited to the particular embodiment shown and described herein, but that various changes and modifications may be made without departing from the spirit or scope of this concept as defined by the following claims.

We claim:

1. A method for making a ferric oxide burning rate enhancing catalyst particularly adapted for use in a rocket propellant comprising (a) vaporizing an iron-containing compound at a temperature below about 500° C.; and
(b) combusting a mixture whereby ferric oxide particles are formed in suspension comprising
  (i) said vaporized iron-containing compound; and
  (ii) lower hydrocarbons, lower ethers or lower oxides of carbon;

whereby the product is a highly active finely divided burning rate catalyst.

2. The method as recited in claim 1 wherein said iron-containing compound has a melting point lower than its vaporization temperature.

3. The method as recited in claim 1 wherein said iron-containing compound is iron carbonyl, ferrocene or a derivative thereof, a iron chelate of a diketone of low molecular weight, a iron halide or a complex ferro- or ferricyanide, or mixtures thereof.

4. The method as recited in claim 1 wherein said iron-containing compound comprises iron pentacarbonyl.

5. The method as recited in claim 1 wherein said lower oxide of carbon is carbon monoxide.

6. A ferric oxide burning rate catalyst made by the process of claims 1, 2, 3, 4 or 5.

7. A composite solid rocket propellant comprising a ferric oxide burning rate catalyst made by the process of claims 1, 2, 3, 4 or 5.

* * * * *